US006950033B1

(12) United States Patent
Guyre

(10) Patent No.: US 6,950,033 B1
(45) Date of Patent: Sep. 27, 2005

(54) DOOR BOLT ALARM

(76) Inventor: Louis N Guyre, 8 Vincent Pl., Verona, NJ (US) 07044

( * ) Notice: Subject to any disclaimer, the term of this patent is extended or adjusted under 35 U.S.C. 154(b) by 0 days.

(21) Appl. No.: 10/348,862

(22) Filed: Jan. 22, 2003

(51) Int. Cl.[7] ..... G08B 21/00; E05B 13/00; E05B 15/00; E05B 17/00; E05B 63/06

(52) U.S. Cl. ..... 340/687; 340/686.1; 340/686.2; 340/686.3; 340/686.4; 340/686.5; 340/542; 340/545.1; 70/134; 70/416

(58) Field of Search ..... 340/686.1–686.5, 340/542, 545.1, 687; 70/49, 134, 416, DIG. 49

(56) References Cited

U.S. PATENT DOCUMENTS

| | | | | |
|---|---|---|---|---|
| 1,723,956 A | | 8/1929 | Schuerman | |
| 2,301,290 A | | 11/1942 | Knight | |
| 2,793,522 A | | 5/1957 | Tornoe | |
| 3,427,835 A | | 2/1969 | Jeffee | |
| 3,514,557 A | | 5/1970 | Jette, Jr. | |
| 4,465,997 A | | 8/1984 | Hines | |
| 4,490,999 A | | 1/1985 | Castle et al. | |
| 4,559,796 A | | 12/1985 | De Forrest, Sr. | |
| 4,593,543 A | * | 6/1986 | Stefanek | 70/134 |
| 4,609,910 A | * | 9/1986 | Geringer et al. | 340/545.1 |
| 4,683,741 A | | 8/1987 | Fields | |
| 4,717,909 A | | 1/1988 | Davis | |
| 5,009,456 A | * | 4/1991 | Eck | 292/173 |
| 5,111,007 A | | 5/1992 | Miller et al. | |
| 5,925,861 A | * | 7/1999 | Fromberg | 200/61.67 |
| 6,078,256 A | * | 6/2000 | Gottlieb | 340/542 |
| 6,212,923 B1 | * | 4/2001 | Clark | 70/416 |
| 6,354,122 B1 | | 3/2002 | Snoke | |

* cited by examiner

*Primary Examiner*—Jeffery Hofsass
*Assistant Examiner*—Lam Pham
(74) *Attorney, Agent, or Firm*—Michael I Kroll

(57) ABSTRACT

A system for determining the position of a bolt in a door including a locking mechanism for moving the bolt between a first locked position wherein the door is secured in position within a door frame and a second unlocked position wherein the door is moveable within the door frame. The position of the bolt is determined by a determining means and a signal indicative of the position of the bolt is generated. A transmitter is connected to the determining means and transmits a signal to a means for indicating to a user the position of the bolt. The indicating means includes a processor and receiver and wherein the transmitter transmits the signals generated by the determining means and the receiver receives the signal and provides the signal to the processor for determining the position of the bolt and generating a signal indicative of the determination.

8 Claims, 10 Drawing Sheets

DOOR BOLT ALARM

BACKGROUND OF THE INVENTION

1. Field of the Invention

The present invention relates generally to alarm systems and, more specifically, to a bolt alarm system for manufacture within a locking mechanism whereby a user is alerted as to the status of a bolt of a lock. The people inhabiting the building where the bolt alarm is active can be notified by means of a visual alarm, an audible alarm or both. The alarm device can be hardwired within the structure or can operate remotely via a transmitter. The alarm device signals the user when the bolt is in either the closed or open position.

2. Description of the Prior Art

Numerous types bolt alarms have been provided in the prior art. For example, U.S. Pat. Nos. 1,723,956; 2,301,290; 2,793,522; 3,427,835; 3,514,557; 4,465,997; 4,490,999; 4,559,796; 4,683,741; 4,717,909; 5,111,007 and 6,354,122 are all illustrative of such prior art. While these units may be suitable for the particular purpose to which they address, they would not be as suitable for the purposes of the present invention as heretofore described.

U.S. Pat. No. 1,723,956

Inventor: William H. Schuerman

Issued: Aug. 6, 1929

This invention relates to improvements in locking mechanisms generally, and more particularly to types of the same as are usually employed for securing doors of buildings, and apartments or rooms of buildings, such as hotels and the like, against unauthorized or unlawful entry.

U.S. Pat. No. 2,301,290

Inventor: Sheldon K. Knight

Issued: Nov. 10, 1942

This invention relates to a door lock switch and has for an object to provide an electric switch combined with a door lock in such a manner that when the door is locked from the outside the electric current is cut off from the lights in a room, home, store, or any place where lights may be inadvertently left burning when there is no one present, while if the door be locked from the inside the electric circuit to the lights is not disturbed.

U.S. Pat. No. 2,793,522

Inventor: John Axel Tornoe

Issued: May 28, 1957

This invention relates primarily to door locks and is especially concerned with locks often used in public buildings such as hotels wherein it is desirable or advisable to have some indication on the lock of the condition of the lock; that is, whether it is in locked condition or unlocked condition. An indicator on the key installations, but in other instances, for example in hotels, there is a need for an indicator of this sort. If the lock terior of the room that the lock has been locked form the outside, the hotel attaches, such as maids or patrolmen, can assume that the room is not occupied.

U.S. Pat. No. 3,427,835

Inventor: Saul Jeffee

Issued: Feb. 18, 1969

A locking arrangement between a door and a wall which includes two latchbolt and keeper means, one of which has lamp indicating means associated therewith. The lamp is actuated by engagement of one latchbolt against a compressible member located in the associated keeper recess to yeildably transmit force to a switch connected to the lamp.

U.S. Pat. No. 3,514,557

Inventor: Emile Jette, Jr.

Issued: May 26, 1970

A door latch operated switch unit for use in energizing an electrical appliance, such as a lamp with a male electrical plug to be connected to a wall outlet, in response to opening and closing of the door which includes: (a) a switching unit for installation in the striker or latch-receiving recess of a door jamb with a member in the path of movement of the latch into and out of the recess to operate the switch, (b) conductor wires leading to (c) a terminal unit to connect to a wall outlet near the door jamb with sockets to receive the leads from the electrical appliance and a plurality of terminal arranged to route current flow (1) in series through the switching unit and the electrical appliance or (2) to interrupt that current flow, depending upon whether the latch is in the door jamb recess or not, i.e., whether the door is open or ajar.

U.S. Pat. No. 4,465,997

Inventor: Thomas N. Hines

Issued: Aug. 14, 1984

An alarm switch for indicating when a latch or dead bolt for a door or window is locked or unlocked comprises a switch casing adapted for mounting on the exterior portion of the door or window frame or door or window; and electrical contact assembly mounted in the casing; a contact assembly actuating member mounted in the casing in position to change the electrical state of the contact assembly by movement of the actuating member from a deactuated to an actuated position, the actuating member being resiliently biased toward its deactuated position but being in position to engage the dead bolt or latch and move to its actuated position when the door or window is shut and the dead bolt or latch is locked, the actuating member being accessible to the door or window latch of dead bolt through an opening in the casing; and electrical terminals on the contact assembly adapted to be connected to a remote alarm system that indicates to the alarm circuit when the door or window bolt or latch is opened. Separate switches are provided for side hinged doors having side mounted dead bolts; for surface mounted dead bolts that are used on overhead doors of the like; and for emergency doors operated by a so-called panic bar. These switches may also be used for certain types of windows.

U.S. Pat. No. 4,490,999

Inventor: Nial K. Castle et al.

Issued: Jan. 1, 1985

A self-contained door lock with an indicating device visible on the inside surface of a door that can be provided as an adaptor for existing door locks or manufactured as part of the original door lock. The indicating device automatically gives a visible indication at the lock location as to whether the door lock is locked or unlocked. The indicating device automatically works in coordination with the door lock mechanism.

U.S. Pat. No. 4,559,796

Inventor: William De Forrest, Sr.

Issued: Dec. 24, 1985

A status indicator for a door lock which is capable of being activated by a tail piece of the door lock has a first linking member which is operatively attached to the tail piece so as to be rotated by the tail piece and a second linking member which attaches between the first linking member and the indicating member. The second linking member translates the rotational movement of the first linking member to translational movement so as to move the indicating member linearly. The indicating member is housed with a housing plate which is attached to the door by the door lock. The indicating member moves within the housing member in response to change of the lock from a locked to an unlocked status and indicates this change so as to indicate the status of the lock, whether it is locked or unlocked.

U.S. Pat. No. 4,683,741

Inventor: Roy A. Fields

Issued: Aug. 4, 1987

A door knob and lock assembly having a pair of knobs, a latching bolt operable by the rotation of the knobs, and a turn button to selectively arrest the movement of the bolt to place the assembly in locked condition. A battery operated electrical circuit including a switch operable by the turn button, and light emitting diode mounted within the door knobs so as to be operable on locking the door to provide a flashing light visible from the outside of the door.

U.S. Pat. No. 4,717,909

Inventor: Jack D. Davis

Issued: Jan. 5, 1988

A housing is mounted interiorly of a doorframe member and houses first and second switch members which move simultaneously in response to entry of a lock bolt and into a strike plate opening. A switch on the housing is in circuit with an indicating unit having illuminated door open and door locked signals and a power source. The first and second switch members are in sliding contact with one another and are displayed laterally away from the lock bolt as it moves to a door locking position. A projection on the first switch member is normally disposed in the strike plate opener.

U.S. Pat. No. 5,111,007

Inventor: Charles D. Miller et al

Issued: May 5, 1992

A switch lock is provided including a lock plug rotatable by a key between two or more positions within a lock barrel, and a switch is associated therewith such that one switch pole is selectively placed in one or more positions by the plug. A visual switch position indicator includes a second switch pole in the switch with a power source connected thereto, and an LED visible from the lock forward end has its leads connected to a terminal for selective connection to a power source in response to the position of the lock plug. The LED leads are flexible, disposed in a groove in the rear face of the lock bezel, and pass through a space between the lock barrel and the opening in the mounting plate. The switch wires are fixed to a connector and are protected by a shrink tube over the switch.

U.S. Pat. No. 6,354,122

Inventor: Steven R. Snoke

Issued: Mar. 12, 2002

A key lock for use on a storage device, primarily a tool box, tool chest or workstation, having integral status indicators for giving a visual indication of whether the storage device is in a locked or unlocked condition. The key lock is preferably comprised of a core portion housing the internal workings of the lock mechanism and a shell portion, which surrounds at least a part of the core portion. At least one LED is secured in the shell portion. A face portion is attached to one end of the core portion, and is designed to receive a key. The other end of the core portion is adapted for attachment to other lock system components. The indicators on the key lock provide visual verification of the locked or unlocked status of the storage device, without the need to manually check each compartment.

SUMMARY OF THE PRESENT INVENTION

The present invention relates generally to alarm systems and, more specifically, to a bolt alarm system for manufacture within a locking mechanism whereby a user is alerted as to the status of a bolt of a lock. The people inhabiting the building where the bolt alarm is active can be notified by means of a visual alarm, an audible alarm or both. The alarm device can be hardwired within the structure or can operate remotely via a transmitter. The alarm device signals the user when the bolt is in either the closed or open position.

A primary object of the present invention is to provide an alarm for use with a locking mechanism that overcomes the shortcomings of the prior art.

Another object of the present invention is to provide a bolt alarm that is able to signal a user that the bolt of a lock is not in the closed position A further object of the present invention is to provide a bolt alarm that is contained within the housing of a locking mechanism.

An even further object of the present invention is to provide a bolt alarm that is able to be used in conjunction with any door Yet another object of the present invention is to provide a bolt alarm that signals the occupants of a structure when a bolt is not in the closed position.

Still yet another object of the present invention is to provide a bolt alarm including a notification device that is hard-wired to the locking mechanism to notify the user that a bolt is in the unlocked position.

Another object of the present invention is to provide a bolt alarm including a remote notification device to notify the user that a bolt is in the unlocked position.

Still another object of the present invention is to provide a bolt alarm with a remote notification device that signals a unit mounted on or in a wall when the bolt is in an unlocked position.

Another object of the present invention is to provide a bolt alarm with a remote notification device that signal a portable unit when the bolt is unlocked position.

Still yet another object of the present invention is to provide a bolt alarm including a visual alarm, audible alarm, or a combination thereof as a method of notifying a user that a bolt is in an unlocked position.

A further object of the present invention is to provide a bolt alarm where the locking mechanism has a switch built therein for generating an alarm signal when a bolt is in the unlocked position.

Yet another object of the present invention is to provide a bolt alarm having a spring loaded lever switch.

Another object of the present invention is to provide a bolt alarm having a magnetic switch.

Yet another object of the present invention is to provide a bolt alarm having a button switch.

Still another object of the present invention is to provide a bolt alarm having a slide spring switch.

A still further object of the present invention is to provide a bolt alarm that is economical in cost to manufacture.

The present invention overcomes the shortcomings of the prior art by providing a bolt alarm that is integral to a locking mechanism for alerting a user when a bolt of the locking mechanism is in an unlocked position. The bolt alarm uses a switch, which when activated signals either closes or opens a circuit. The completed circuit causes the transmitter to send a signal to a notification device which uses a light or sound to indicate to a user that the bolt is in a locked or unlocked position.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

In order that the invention may be more fully understood, it will now be described, by way of example, with reference to the accompanying drawing in which:

FIG. 1 is an illustrative view of the bolt alarm system of the present invention in use showing users in a room of a building being notified that the bolt of their door lock is in locked position;

FIG. 2 an illustrative view of the bolt alarm of the present invention in use in a commercial setting to alert a user at a remote location that a bolt on a door is being unlocked;

FIG. 3*a* is a cut away view of the bolt alarm of the present invention having a magnetic plate switch for notifying a user that the bolt is in a locked position;

FIG. 3*b* is a cut away view of the bolt alarm of the present invention having a button switch for notifying a user that the bolt is in a locked position;

FIG. 3*c* is a cut away view of the bolt alarm of the present invention having a spring loaded lever switch for notifying a user that the bolt is in a locked position;

FIG. 3*d* is a cut away view of the bolt alarm of the present invention having a slide switch for notifying a user that the bolt is in a locked position;

Figure 1:
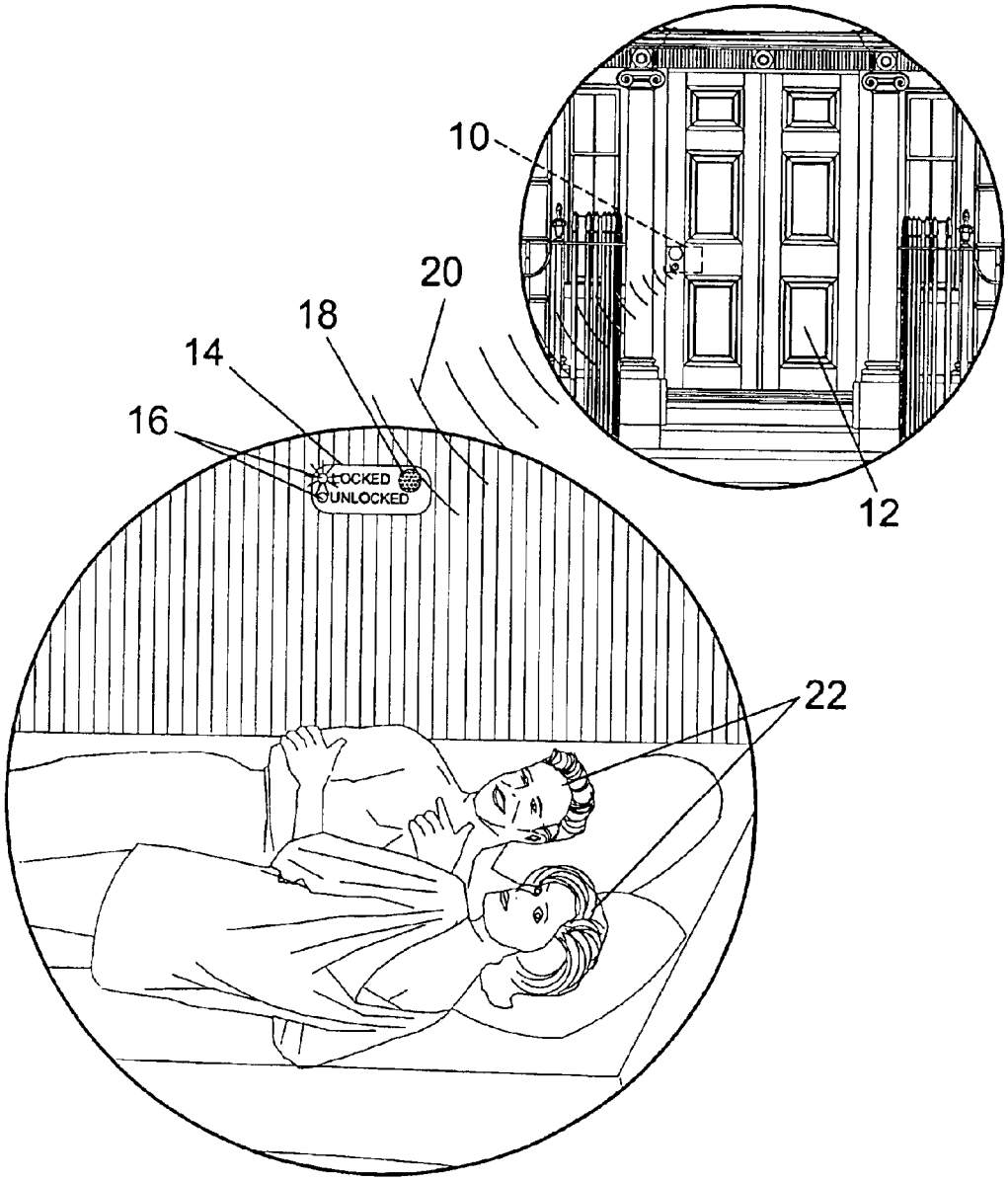

The foregoing and other objects and advantages will appear from the description to follow. In the description, reference is made to the accompanying drawing, which forms a part hereof, and in which is shown by way of illustration specific embodiments in which the invention may be practiced. These embodiments will be described in sufficient detail to those skilled in the art to practice the invention, and it is to be understood that other embodiments may be utilized and that structural changes may be made without departing from the scope of. In the accompanying drawings, like reference characters designate the same or similar parts throughout the several views

DESCRIPTION OF THE REFERENCED NUMERALS

Turning now descriptively to the drawings, in which similar reference characters denote similar elements throughout the several views, the Figures illustrate the phone-alarm of the present invention. With regard to the reference numerals used, the following numbering is used throughout the various drawing Figures.

10 bolt alarm of the present invention
11 commercial building
12 door
13 door frame
14 indicator
15 recess
16 visual indicator
17 receiver
18 Audible Indicator
20 data signal
22 user
24 remote indicator
27 cylinder
28 locking mechanism
29 bolt
30 magnetic switch
32 magnetic plate
34 transmitter
36 power source
38 first set of electrical contacts
39 first wire
40 middle plate with dual electrical contacts
42 bias spring
44 second set of electrical contacts
45 second wire

46 button switch mechanism
47 base of button
48 button
49 recess
50 spring-loaded lever switch
51 third electrical contact
52 first well with a fifth electrical contact
53 fourth electrical contact
54 second well with a sixth electrical contact
55 channel
56 lever
57 pivot point connecting lever to bolt
58 first spring
60 slide spring
61 electrical contact on end of lever
62 anchor
63 arm of the slide
64 slide switch
65 base of the slide
66 upward extending member
70 Control Console
72 receiver
74 processor
76 transmitter
78 power source
80 remote indicator
82 receiver
84 processor
86 display
88 power source
90 audible indicator

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments. Practitioners skilled in the art will recognize numerous other embodiments as well. For a definition of the complete scope of the invention, the reader is directed to the appended claims.

Turning now descriptively to the drawings, in which similar reference characters denote similar elements throughout the several views. FIGS. 1 through 10 illustrate the bolt alarm of the present invention indicated generally by the numeral 10.

FIG. 1 is an illustrative view of the bolt alarm system 10 of the present invention in use showing users in a room of a building being notified that the bolt of their door lock is in the locked position. The bolt alarm 10 of the present invention notifies a user of the position or status of the bolt of a locking mechanism contained within a door. The method by which the position of the bolt within the locking mechanism is determined will be discussed hereinafter with specific reference to FIGS. 3–8. An indicator 14 is provided at a location selected by a user 22 for providing notification of the position of the bolt within the locking mechanism. The indicator 14 includes a visual indicator 16 and an audible indicator 18. The bolt alarm 10 of the present invention transmits a data signal 20 which is received by the indicator 14. If the bolt is in the locked position the user may be notified of the position of the bolt by either illumination of the visual indicator 16, a sound generated by the audible indicator 18 or combination of both. If the bolt is in the unlocked position, the user may also be notified of the position of the bolt by illumination of the visual indicator 16, a sound generated by the audible indicator 18 or combination of both. However, while the same indication means ate used, the style of the notification should differ sufficiently to allow a user to properly distinguish between the alerts. The visual indicator can illuminate a first color when the bolt is in the locked position and a second color when the bolt is in the unlocked position. The audible indicator can emit a first auditory tone when the bolt is in the locked position and a second auditory tone when the bolt is in the unlocked position. The above is provided for purposes of example and any method that is able to visually and audibly alert a user as to the status of a bolt in a locking mechanism may be used. Alternatively, the audible and visual indicators may only generate audible and visual alarms for a single position of the bolt while not generating audible and visual alarms when the bolt is in the other position.

Figure 2:
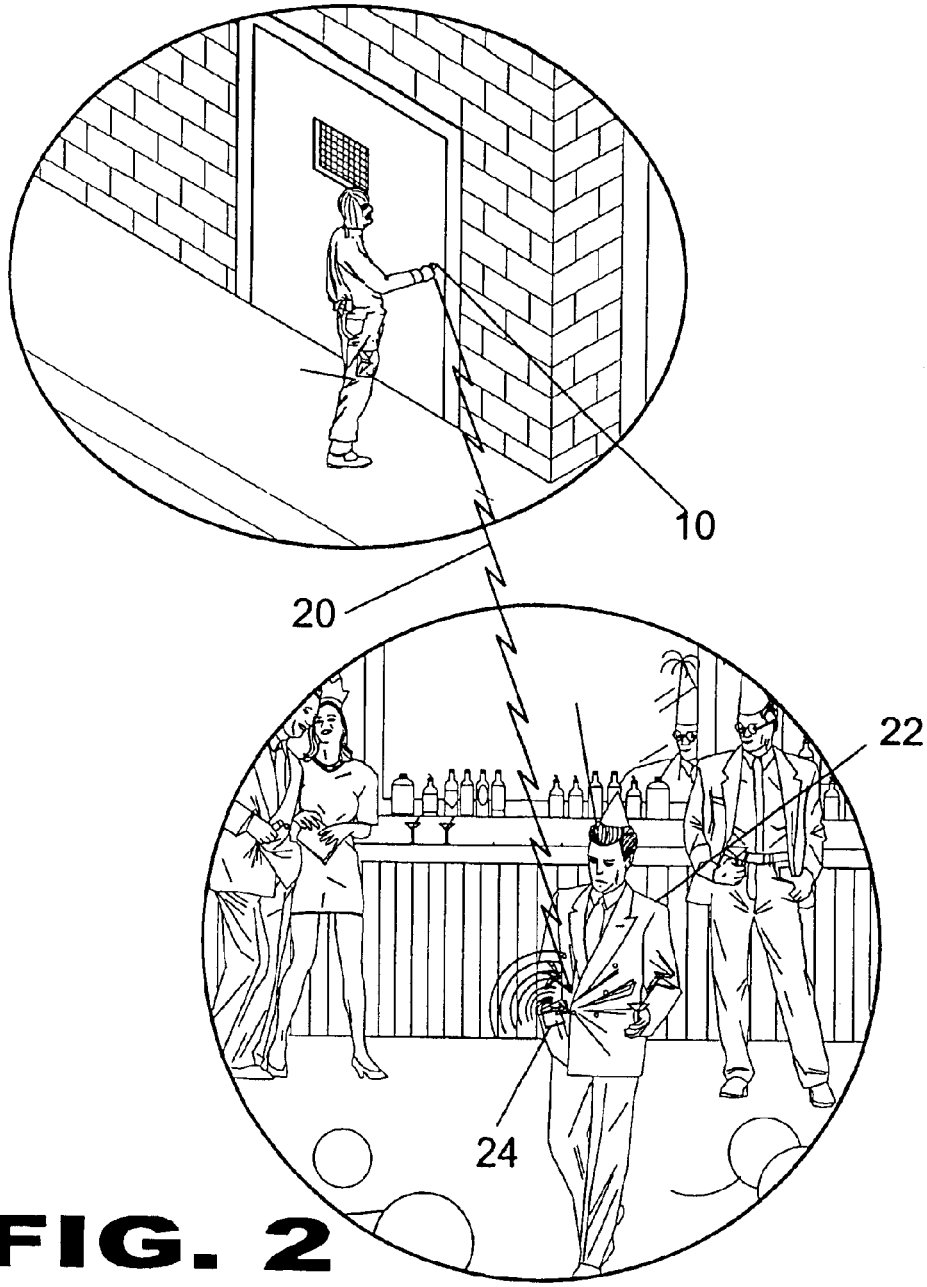

FIG. 2 is an illustrative view of the bolt alarm of the present invention used in a commercial setting including remote notification of an alarm situation. FIG. 2 shows a commercial building 11 equipped with the bolt alarm 10 of the present invention. The bolt alarm 10 can be installed for use with any door in any building. The bolt alarm 10 of the present invention notifies a user of the position or status of the bolt of a locking mechanism contained within a door of the commercial building 11. The method by which the position of the bolt within the locking mechanism is determined will be discussed hereinafter with specific reference to FIGS. 3–8. This figure shows a user 22 having a remote indicator unit 17. The remote indicator 17 includes a visual indicator 16 and an audible indicator 18. The bolt arm 10 of the present invention is connected to a bolt on a door and is able to generate and transmit a data signal 10 to the remote indicator 17 indicating the position of the bolt. If the bolt is in the locked position the user may be notified of the position of the bolt by either illumination of the visual indicator 16, a sound generated by the audible indicator 18 or a combination of both. If the bolt is in the unlocked position, the user may also be notified of the position of the bolt by illumination of the visual indicator 16, a sound generated by the audible indicator 18 or combination of both. However, while the same indication means are used, the manner of notification should differ sufficiently to allow a user to properly distinguish between the alerts. The visual indicator can illuminate a first color when the bolt is in the locked position and a second color when the bolt is in the unlocked position. The audible indicator can emit a first auditory tone when the bolt is locked and a second auditory tone when the bolt is unlocked. The above is provided for purposes of example and any method that is able to visually and audibly alert a user as to the position of a bolt in a locking mechanism may be used. Alternatively, the audible and visual indicators may only generate audible and visual alarms for a first position of the bolt while not generating audible and visual alarms when the bolt is in a second position.

FIGS. 3*a*–*d* are cross-sectional views of four embodiments of the bolt alarm system of the present invention. In each embodiment, the bolt alarm 10 uses a switching mechanism to determine the position of the bolt of the locking mechanism. The bolt alarm can utilize at least one of a magnetic switching mechanism 30 as in FIG. 3*a*, a button switching mechanism 46 as in FIG. 3*b*, a spring loaded lever switching mechanism 50 as in FIG. 3*c*, and a slide spring switching mechanism 64 as in FIG. 3*d*. The magnetic switching mechanism 30 will be discussed hereinafter with specific reference to FIGS. 4 and 5. The button switching mechanism 46 will be discussed hereinafter with specific reference to FIG. 6. The spring loaded lever switching mechanism will be discussed hereinafter with specific reference to FIG. 7. The slide spring switching mechanism will be discussed hereinafter with specific reference to FIG. 8.

While these four embodiments are the preferred embodiments for the bolt alarm 10 of the present invention, any switching mechanism that can be used to detect the position of the bolt within the locking mechanism can be used.

Figure 3A:
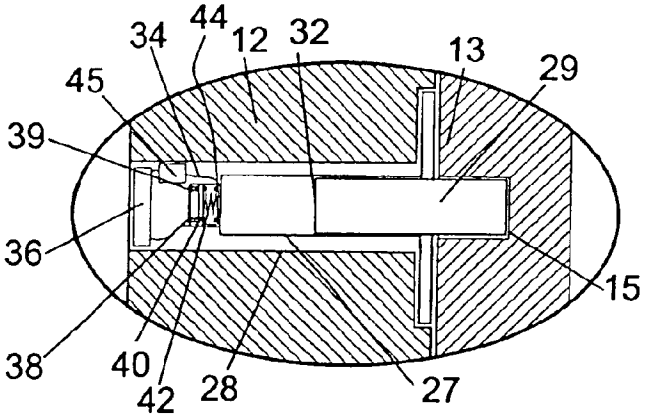

FIG. 3*a* is a cross-sectional view of the bolt alarm 10 of the present invention having a magnetic plate switch 30 for notifying a user that a bolt of a locking mechanism is in a locked position. The magnetic plate switch 30 is moveable between a first position against a first plate and a second position against a second plate. Movement of the magnetic plate 40 between the first position and the second position is determined by a magnetic plate 32 connected to the bolt 29. When the bolt 29 is in the unlocked position the magnetic plate 32 positioned thereon attracts the magnetic plate switch 30 with a magnetic force able to overcome the force of a bias spring contested between, the magnetic plate switch 30 and the first plate thereby causing electrical contracts on the magnetic plate 40 to contact electrical contacts on the second plate and complete an electrical circuit. Upon completing the circuit, a transmitter 34 is signaled that the bolt 29 is in the unlocked position. The transmitter 34 then signals an indicator 14 to notify a user that the bolt 29 is in an unlocked position. Upon moving the bolt into the locked position, the bias spring is able to overcome the magnetic force of the magnetic plate 32 as the bolt 29 moves away from the magnetic plate switch 30 causing a second set of electrical contacts on the magnetic plate switch 30 to contact electrical contacts on the first plate and complete an electrical circuit. Upon completing this second electrical circuit, a transmitter is signaled that the bolt is in the locked position. The transmitter then signals an indicator that the bolt is in the locked position.

Figure 3B:
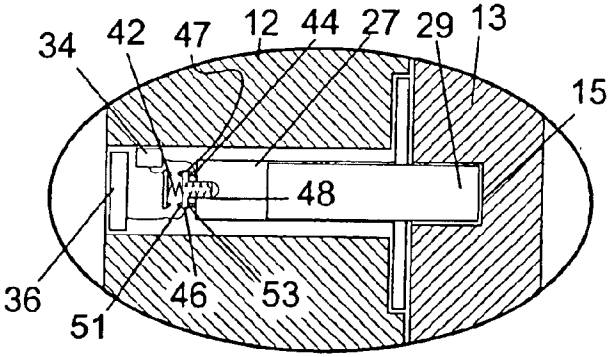

FIG. 3*b* is a cross-sectional view of a the bolt alarm 10 of the present invention having a button switching mechanism for notifying a user of the position of a bolt in a locking mechanism. The button is has a base 47 and a tip 48. A bias spring 42 is connected between the first plate 38 and the base 47. The bias spring 42 applies a font against the base 47 causing the base to contact the second plate 44 when the bolt is in the locked position. The tip 48, because of the force exerted by a bias spring 42, extends through a recess 49 in the cylinder 27 of the locking mechanism 28 when the bolt is in the locked position. When the base 47 contacts the second plate, a first set of electrical contacts on the base 47 are brought into contact with electrical contacts on the second plate 44 thereby completing an electrical circuit. A transmitter 34 is then signaled that the bolt is in the locked position. Upon receiving this signal, the transmitter 34 signals an indicator 14 that the bolt 29 is in the locked position. When the bolt 29 is moved from the locked position to the unlocked position, the bolt 29 applies a force against the tip 48 of the button which overcomes the force of the bias spring 42 and forces the tip of the button out of the cylinder 27 thereby causing the base to move towards the first plate 38. Upon contacting the first plate 38, a second set of electrical contacts on the base contact electrical contacts on the first plate 38 thereby completing an electrical circuit. Upon completion of the electrical circuit a transmitter is signaled that the bolt is in the unlocked position. The transmitter then signals an indicator that the bolt is in the unlocked position.

Figure 3C:
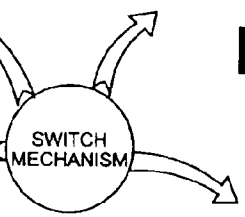
Figure 3C:
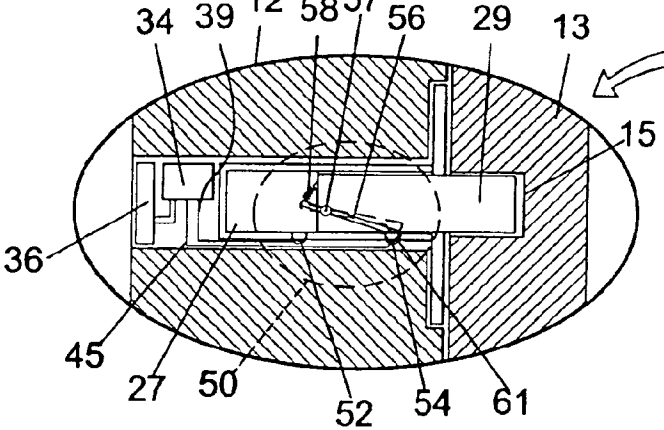

FIG. 3*c* is a cross-sectional view of the bolt alarm 10 of the present invention having a spring loaded lever switch for notifying a user of the position of a bolt of a locking mechanism. The cylinder 27 of the locking mechanism 28 has a first well 52 with electrical contacts therein and a second well 54 with electrical contracts therein. The bolt 29 has a spring loaded lever 56 pivotally connected thereto. The lever 56 has an electrical contact 61 on an end thereof. When the bolt 29 is in the locked position, the electrical contact 61 on the lever 56 sits in the first well 52 thereby completing a fast electrical circuit. A transmitter 34 is then signaled that the bolt 29 is in the unlocked position. Upon moving the bolt 29 from the unlocked position to the locked position, the electrical contact 61 of the lever 56 is forced out of the first well 52 and slides along the base of the cylinder 27 until the electrical contact 61 of the lever 56 rests in the second well 54 thereby completing a second electrical circuit. A transmitter 34 is then signaled that the bolt 29 is in the locked position. The transmitter 34 that signals the indicator 14 that the bolt is in the locked position.

Figure 3D:
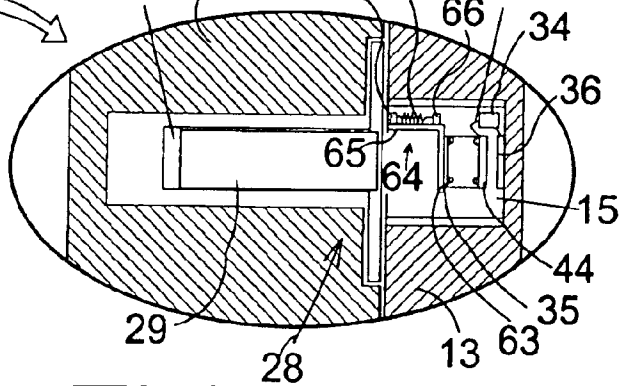

FIG. 3*d* is a cross-sectional view of the bolt alarm 10 of the present invention having a slide-spring switch mechanism for notifying a user of the position of a bolt within a locking mechanism. The slide spring switch 64 is positioned within a recess 15 of a door frame 13. The slide-spring switch 64 has a base 65 and on arm 63 extending perpendicularly therefrom. The base 65 has an upward extending member 66 at the position of perpendicular connection of the base 65 and the arm 63. A tension spring 60 is connected to the upward extending 66 member for connecting the slide spring switch 64 to the door frame 13. The arm 63 of the slide switch 64 has a first set of electrical contacts 38 positioned thereon. A second set of electrical contacts 44 are positioned within the recess 15 of the door frame 13 opposite the rust set of electrical contacts 38. When the bolt is in the unlocked position, the tension spring 60 biases the slide switch away from the second set of electrical contacts 44 and thus the first and second sets of electrical contacts are not in contact. A signal indicating such is sent to the transmitter 34 thereby notifying the transmitter that the bolt 29 is in the unlocked position. Upon receiving the signal, the transmitter 34 signals an indicator 14 to notify the user that the bolt is in the unlocked position. When the bolt 29 is moved into the locked position the bolt 29 extends partially from the cylinder 27 of the locking mechanism 28 into the recess 15 of the door frame 13 and applies a force to the slide spring switch 64. This force is great enough to overcome the bias of the spring connecting the slide switch 64 to the door frame 13 and thereby move the slide switch 64 into a second position against the second set of electrical contacts 44. In this position the first set of electrical contacts 38 are in contact with the second set of electrical contacts 44 thereby completing an electrical circuit. Upon completing of the circuit, a signal indicating that the bolt 29 is in the locked position is sent to the transmitter 34. The transmitter 34 then signals the indicator 14 that the bolt is in the locked position.

Figure 4:
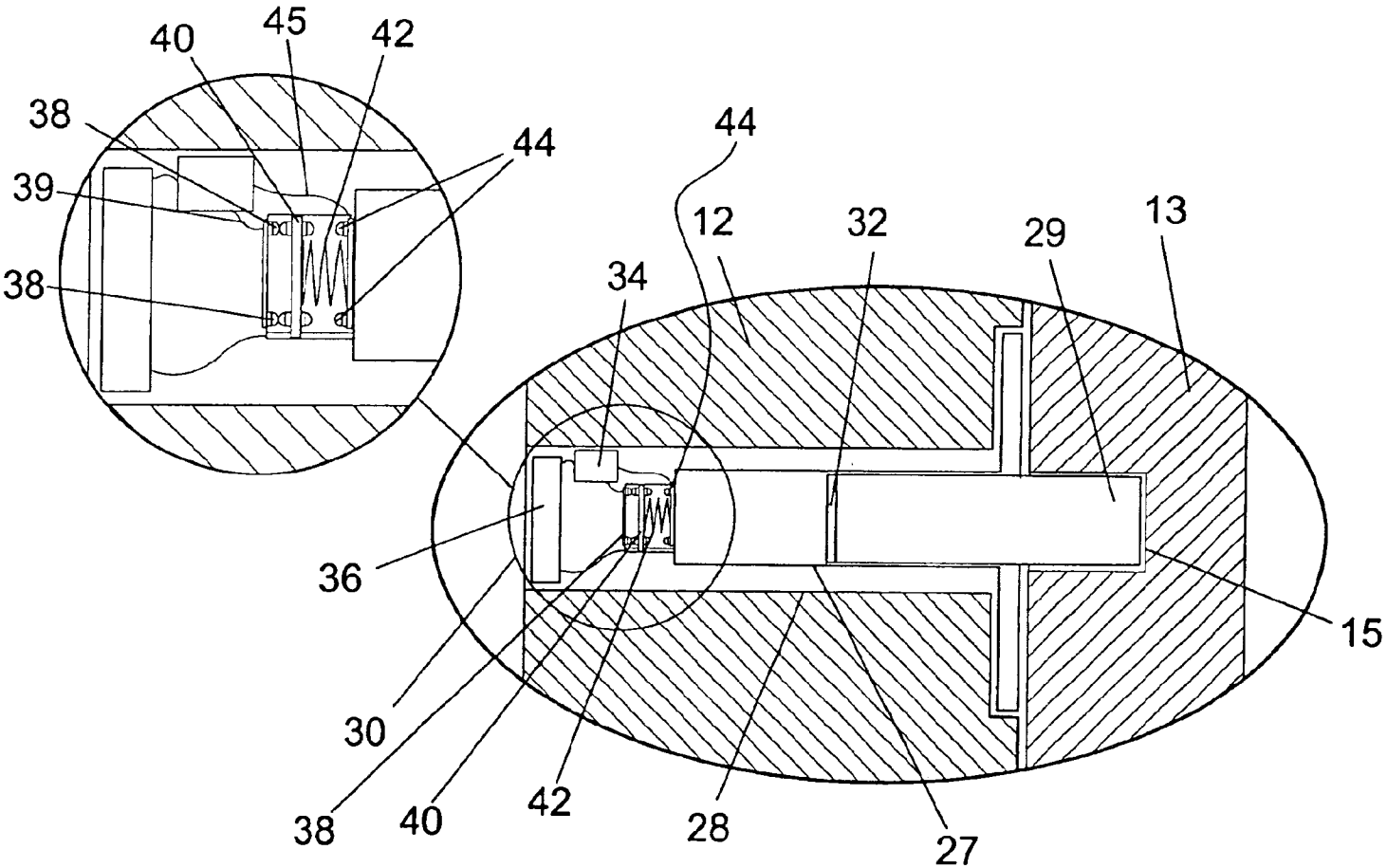
FIG. 4 is a cross-sectional view of the bolt alarm of the present invention utilizing a magnetic plate switch for notifying a user that the bolt is in a locked position.

FIG. 4 is a cross-sectional view of the bolt alarm 10 of the present invention utilizing a magnetic plate switch for notifying a user that a bolt 29 of a locking mechanism 28 is in a locked position. FIG. 4 shows the locking mechanism 28 within a door 12. The door 12 is shown flush with the door frame 13. The door frame 13 has a recess 15 extending therein for receiving the bolt 29. The locking mechanism includes a cylinder 27 and the bolt 29 is at least partially contained within the cylinder 27. When the bolt 29 is in the unlocked position the bolt is contained completely within the cylinder 27 of the locking mechanism 28. When the bolt 29 is in the locked position, the bolt 29 extends partially out of the cylinder 27 and is received by the recess 15 in the door frame 13 thereby locking the door within the door frame 13 and preventing the door 12 from being opened.

The bolt alarm 10 of the present invention includes a magnetic switching mechanism 30 to determine the position of the bolt 19 within the locking mechanism 28. The locking mechanism includes a power source 36 and a transmitter 34 connected thereto. A first set of electrical contacts 38 is positioned within the locking mechanism on a side of the cylinder opposite the bolt cad is connected to the transmitter 34 by a first wire 39. A second set of electrical contacts 44 is positioned at the end of the cylinder 27 of the locking mechanism 28. The second set of electrical contacts 44 is also connected to the transmitter 34. A middle plate having electrical contacts 40 on either side thereof is connected to the second set of electrical contacts 44 by a bias spring 42 and positioned between the first and second set of electrical contacts, 38 and 44 respectively. The bias spring 42 biases the middle plate towards the first set of electrical contacts 38.

In the present embodiment, the middle plate 40 is formed from material that is attracted to a magnet. The bolt 29 has a magnetic plate 32 positioned on an end adjacent to the second set of electrical contacts 44. When the bolt 29 is in a locked position thereby extending partially into the recess 15 of the door frame 13, the magnetic plate is in a position distanced from the middle plate 40 and the magnetic force of the magnetic plate 32 is not strong enough to overcome the bias force of the spring 42. Thus, the bias spring 42 biases the middle plate 40 towards the first set of electrical contacts 38 whereby the electrical contacts on the middle plate 40 are placed in contact with the first set of electrical contacts 38 thereby completing an electrical circuit. The completion of the circuit sends a signal to the transmitter 34 indicating the bolt is in the locked position. Upon completing the electrical circuit and receipt of the signal, the transmitter 34 signals the indicator 14 that the bolt 29 of the locking mechanism 28 is in a locked position.

Figure 5:
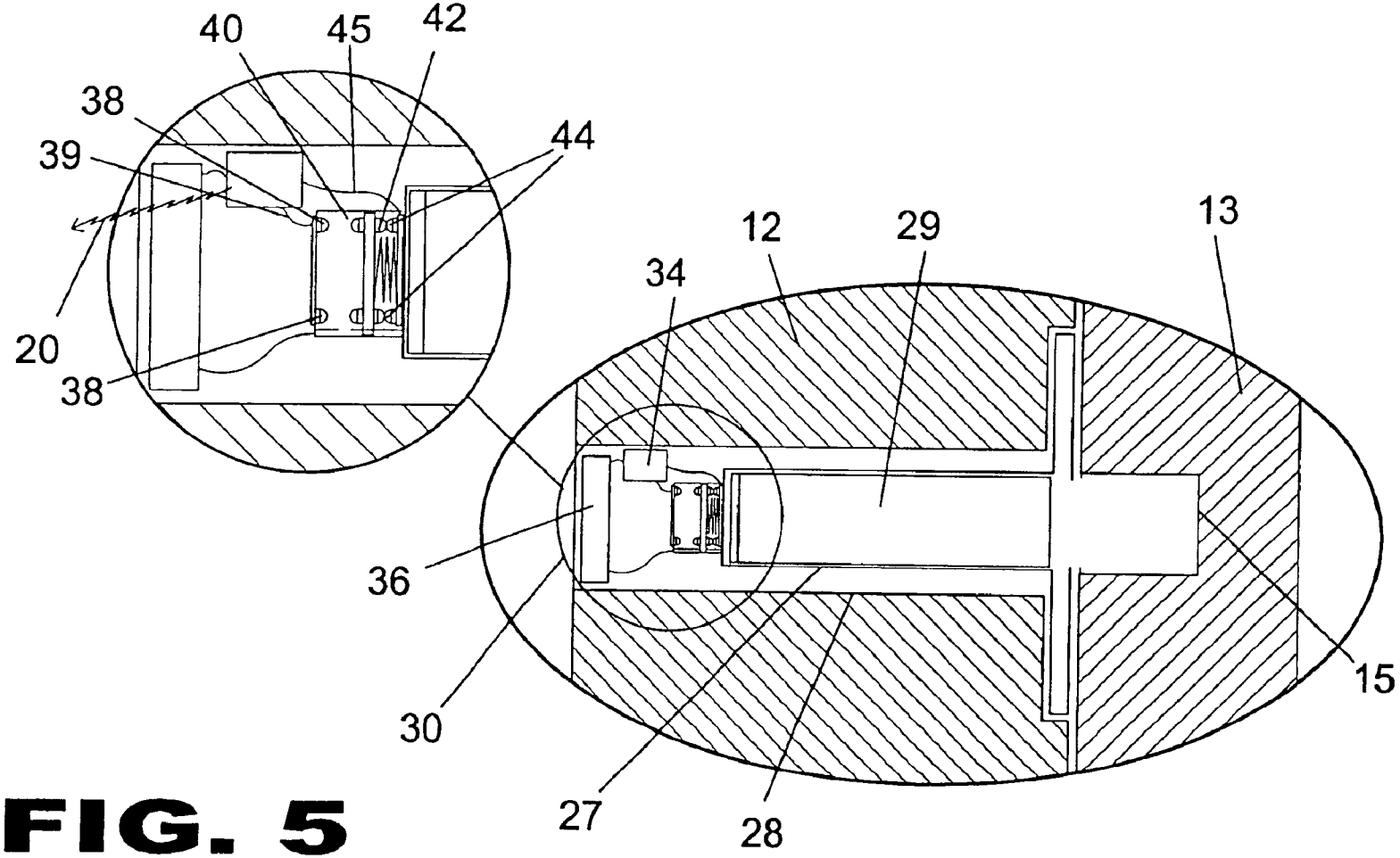
FIG. 5 is a cross-sectional view of the bolt alarm of the present invention utilizing a magnetic plate switch for notifying a user that the bolt is in an unlocked position.

FIG. 5 is a cross-sectional view of the bolt alarm of the present invention utilizing a magnetic plate switch for notifying a user that the bolt is in a unlocked position. FIG. 5 shows the locking mechanism 28 within a door 12. The door 12 is shown flush with the door frame 13. The door frame 13 has a recess 15 extending therein for receiving the bolt 29. The locking mechanism includes a cylinder 27 and the bolt 29 is at least partially contained within the cylinder 27. When the bolt 29 is in the unlocked position the bolt is contained completely within the cylinder 27 of the locking mechanism 28. When the bolt 29 is in the locked position, the bolt 29 extends partially out of the cylinder 27 and is received by the recess 15 in the door frame 13 thereby locking the door within the door frame 13 and preventing the door 12 from being opened.

The bolt alarm 10 of the present invention includes a magnetic switching mechanism 30 to determine the position of the bolt 29 within the locking mechanism 28. The locking mechanism includes a power source 36 and a transmitter 34 connected thereto. A first set of electrical contacts 38 is positioned within the locking mechanism on a side of the cylinder opposite the bolt and is connected to the transmitter 34 by a first wire 39. A second set of electrical contacts 44 is positioned at the end of the cylinder 27 of the locking mechanism 18. The second set of electrical contacts 44 is also connected to the transmitter 34. A middle plate having electrical contacts 40 on either side thereof is connected to the second set of electrical contacts 44 by a bias spring 42 and positioned between the first and second set of electrical contacts, 38 and 44 respectively. The bias spring 42 biases the middle plate towards the first set of electrical contacts 38.

When the bolt 29 is in the unlocked position within the cylinder 27 of the locking mechanism 28, the magnetic plate 32 is positioned adjacent to the second set of electrical contacts 44. The magnetic force from the magnetic plate 32 in this position is able to overcome the bias force of the bias spring 42 causing the middle plate 40 to be attracted thereto. Upon recoiling of the bias spring 42, the electrical contacts on the middle plate 40 are brought into contact with the second set of electrical contacts 44 thereby completing an electrical circuit. The completion of the circuit causes a signal to be sent to the transmitter 34 indicating the bolt is in the unlocked position. Upon completion of this electrical circuit and receipt of the signal, the transmitter 34 signals the indicator 14 that the bolt 29 of the locking mechanism 28 is in an unlocked position.

Figure 6:
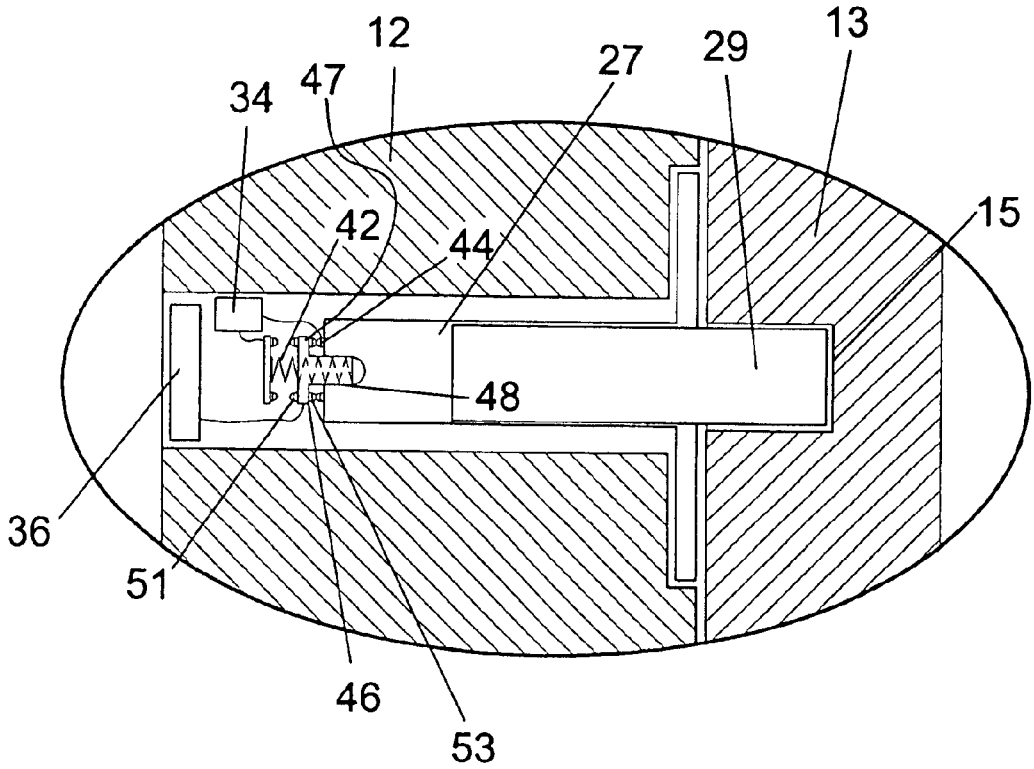
FIG. 6 is a cross-sectional view of the bolt alarm of the present invention having a button switch mechanism for notifying a user as to the status of the bolt in a locking mechanism.

FIG. 6 is a cross-sectional view of the bolt alarm of the present invention having a button switch mechanism for notifying a user as to the status of the bolt in a locking mechanism. FIG. 6 shows the locking mechanism 28 within a door 12. The door 12 is shown flush with the door frame 13. The door frame 13 his a recess 15 extending therein for receiving the bolt 29. The locking mechanism includes a cylinder 27 and the bolt 29 is at least partially contained within the cylinder 27. When the bolt 29 is in the unlocked position the bolt is contained completely within the cylinder 27 of the locking mechanism 28. When the bolt 29 is in the locked position, the bolt 29 extends partially out of the cylinder 27 and is received by the recess 15 in the door frame 13 thereby locking the door within the door frame 13 and preventing the door 12 from being opened.

At bolt alarm 14 of the present invention includes a button switching mechanism 46 to determine the position of the bolt 29 within the cylinder 27. The locking mechanism 28 includes a power source 36 and a transmitter 34 connected thereto. A first set of electrical contacts 38 is positioned within the locking mechanism 28 on a side of the cylinder 27 opposite the bolt 29 and is connected to the transmitter 34 by a fast wire 39. A second set of electrical contacts 44 is positioned at the end of the cylinder 27 of the locking mechanism 28. The cylinder 27 has a recess 49 in a base side thereof. The button switch 46 includes a button having a base 47 positioned outside the cylinder between the base of the cylinder and the first set of electrical contacts 38, and a tip 48 extending from the base 47 through the recess 49 and into the cylinder 27. A third set of electrical contacts 51 is connected to a first side of the base 47 of the button switch 46 and fourth set of electrical contacts 53 is positioned on a side of the base 47 opposite the third set of electrical contacts 51. A bias spring 42 is connected between the fast set of electrical contacts 38 and the base 47 of the button switch 46. The spring 42 is biased to hold the base of the button switch 46 against the base of the cylinder thereby causing the fourth set of electrical contacts 53 to be in contact with the second set of electrical contacts 44. The spring 42 thus also causes the tip 48 to extend through the recess 49 into the cylinder 27. When the tip 48 extends into the cylinder 27, the bolt 29 is in the locked position. This embodiment is similar to that shown in the FIGS. 4 and 5 with the button switch 46 replacing the magnetic plates 40.

When the bolt 29 of the locking mechanism 28 is in the locked position, thereby extending from the cylinder 27 and into the recess 15 of the door frame 13, the spring 42 exerts a bias against the base 47 of the button switch 46 causing the tip 48 to extend through the recess 49 and into the cylinder 27. The bias force of the spring 42 forces the fourth set of electrical contacts 53 to be brought into contact with the second set of electrical contacts 44 thereby completing an electrical circuit. Upon completion of the circuit a signal is sent to the transmitter 34 indicating the contact between the second and fourth set of electrical contacts, 44 and 53 respectively. Upon receipt of this signal, the transmitter 34 signals the indicator 14 that the bolt 29 of the locking mechanism 28 is in a locked position.

When the boll 29 of the locking mechanism 28 is moved into the unlocked position the bolt is caused to move into the cylinder 27 of the locking mechanism 28. When in this position the bolt 29 contacts and applies a force against the tip 48 of the button 46 causing the tip 48 to be moved out of the cylinder 27 overcoming the bias force of the spring 42. When the bolt 29 moves completely within the cylinder 27, the base 47 of the button switch 46 is forced to move away from the base of the cylinder 27 and towards the fast set of electrical contacts 38. As the bolt extends further into the cylinder the tip 48 of the button 46 is forced out of the cylinder 27 unfit the third set of electrical contacts 51 on the base 47 are brought into contact with the first set of electrical contacts 38 to thereby complete an electrical circuit. Upon completion of the circuit a signal is sent to the transmitter 34 indicating the contact between the first and third set of electrical contacts, 38 and 51 respectively and thus movement of the bolt into the unlocked position. Upon receipt of this signal, the transmitter 34 signals the indicator 14 that the bolt 29 of the locking mechanism 28 is in an unlocked position.

Figure 7:
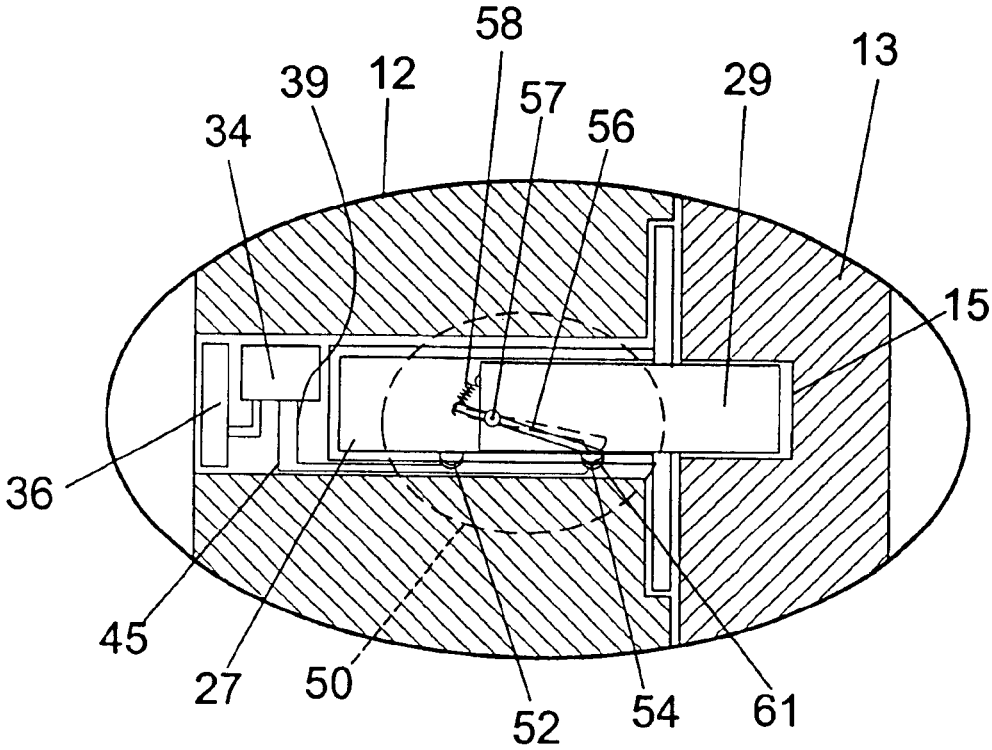
FIG. 7 is a cross-sectional view of the bolt alarm of the present invention having a lever switch mechanism for notifying a user as to the status of the bolt in a locking mechanism.

FIG. 7 is a cross-sectional view of the bolt alarm of the present invention having a lever switch mechanism for notifying a user as to the status of the bolt in a locking mechanism. FIG. 7 shows the locking mechanism 28 within a door 12. The door 12 is shown flush with the door frame 13. The door frame 13 has a recess 15 extending therein for receiving the bolt 29. The locking mechanism includes a cylinder 27 and the bolt 29 is at least partially contained within the cylinder 27. When the bolt 29 is in the unlocked position the bolt is contained completely within the cylinder 27 of the locking mechanism 28. When the bolt 29 is in the locked position, the bolt 29 extends partially out of the cylinder 27 and is received by the recess 15 in the door frame 13 thereby locking the door within the door frame 13 and preventing the door 12 from being opened.

The bolt alarm 10 of the present invention uses a spring loaded lever switching mechanism 50 to determine the position of the bolt 29 within the locking mechanism 28. The locking mechanism 28 includes a power source 36 and a transmitter 34 connected thereto. A lever 56 is pivotally connected to the bolt 29 at a pivot point 57 and biased a side of the cylinder 27 by a first spring 58. The lever 56 includes an electrical contact 61 positioned at an end opposite the end connected to the fist spring 58.

Within the cylinder 27 of the locking mechanism 28 is a first well 52 having an electrical contact therein and a second well 54 having an electrical contact therein. When in the unlocked position, the bolt 29 is contained completely within the cylinder 27 thereby causing the electrical contact 61 of the lever 56 to rest in the first well 52. When the electrical contact 61 of the lever 61 is positioned within the first well 52, an electrical circuit is complete. Upon completion of the electrical circuit a signal is sent to the transmitter 34 indicating the bolt is in the unlocked position. Upon receipt of this signal, the transmitter 34 signals the indicator 14 that the bolt 29 is in the unlocked position.

When the bolt 29 is moved from the unlocked position into the locked position, the bolt 29 passes through the cylinder 27 and partially extends therefrom into the recess 15 of the door frame 13. When the bolt 29 is moved, a force is applied to the lever overcoming the bias force of the spring 58 and causing the lever 56 to pivot about the pivot point 57 and unseat the electrical contact 61 from within the first well 52. As the bolt 29 slides along the cylinder 27, the electrical contact 61 slides along the base thereof. As the bolt 29 extends partially from the cylinder 27 into the recess 15 of the door frame 13, the second spring 58 applies a bias against the lever 56 which causes the lever 56 to pivot about the pivot point 57 thereby causing the electrical contact 61 to be positioned within the second well 54. When the electrical contact 61 is positioned within the second well 54, an electrical circuit is complete. Upon completion of the electrical circuit, a signal is sent to the transmitter 34 indicating the movement of the bolt 29 into the locked position. Upon receipt of this signal the transmitter 34 to signals to the indicator 14 that the bolt 29 is in the locked position.

Figure 8:
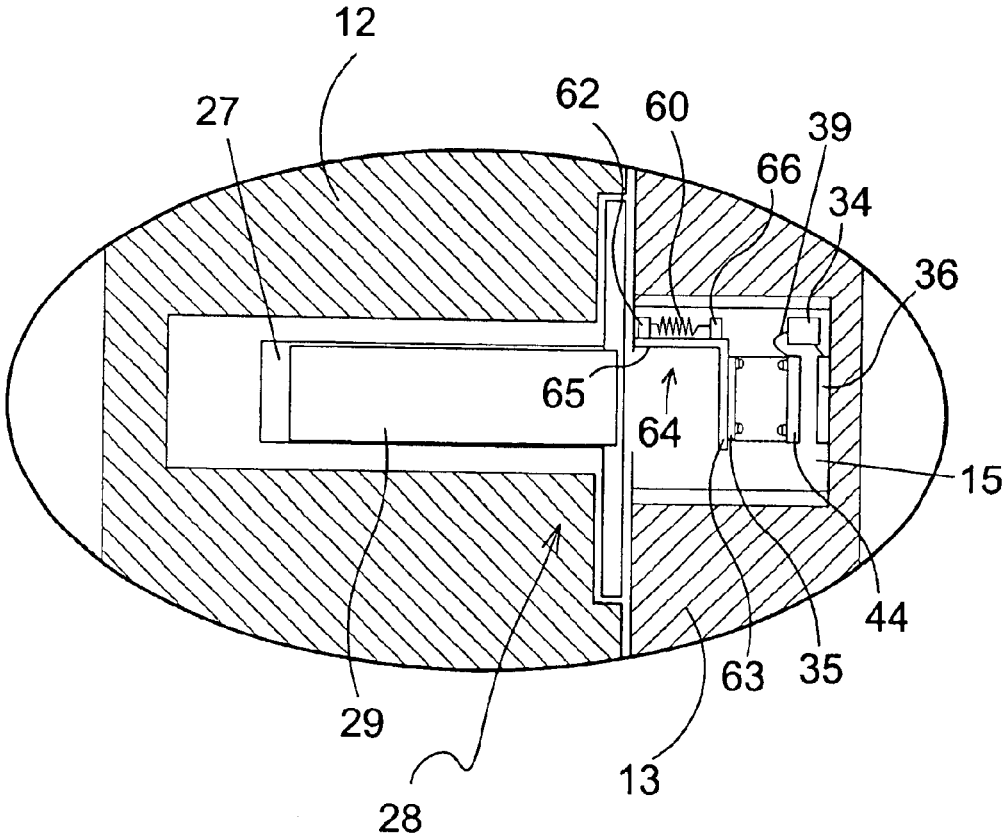
FIG. 8 is a cross-sectional view of the bolt alarm of the present invention having a spring switch mechanism for notifying a user as to the status of the bolt in a locking mechanism.

FIG. 8 is a cut away view of the bolt alarm of the present invention having a spring switch mechanism for notifying a user as to the status of the bolt in a locking mechanism. FIG. 8 shows the locking mechanism 28 within a door 12. The door 12 is shown flush with the door frame 13. The door frame 13 has a recess 15 extending therein for receiving the bolt 29. The locking mechanism includes a cylinder 27 and the bolt 29 is at least partially contained within the cylinder 27. When the bolt 29 is in the unlocked position the bolt is contained completely within the cylinder 27 of the locking mechanism 28. When the bolt 29 is in the locked position, the bolt 29 extends partially out of the cylinder 27 and is received by the recess 15 in the door frame 13 thereby locking the door within the door frame 13 and preventing the door 12 from being opened.

The bolt alarm 10 of the present invention uses a slide spring switched mechanism 64 to determine the position of the bolt 29 within the locking mechanism 28. The slide switching mechanism 64 is located within the recess 15 of the door frame 13. The slide switching mechanism is formed from a base 65 and an arm 63 extending perpendicularly from an end of the base 65. A further member 66 extends upwardly from a side of the base 65. An anchor 62 is secured to the door frame 13 and aligned with the member 66. A spring 60 is connected between the anchor 62 and the further member 66 thereby biasing the base 65 against a side of the door frame 13 to which the anchor 62 is connected. The arm 63 of the slide spring 64 has a first set of electrical contacts connected thereto. A second set of electrical contacts 44 is positioned at the base of the recess 15. The recess 15 also includes a power source 36 and a transmitter 34. The first set of electrical contacts 38 is connected to the transmitter by a first wire 39.

When the bolt 29 is in the unlocked position, the bolt 29 is contained within the cylinder 27 of the locking mechanism 28 and the spring 60 places a bias on the slide switching mechanism 64 causing the base 65 to rest perpendicularly against the door frame 13 thereby preventing contact between the first set of electrical contacts 38 and the second set of electrical contacts 44. This results in the electrical circuit located in the recess 15 of the door frame 13 to be open thereby causing the transmitter 34 to signal the indicator 14 that the bolt 29 is in an unlocked position. Upon receipt of the signal, the transmitter signals the indicator 14 that the bolt is in the unlocked position.

When the bolt 29 is moved into the locked position, the bolt 29 extends partially from the cylinder 27 and into the recess 15 of the door frame 13. Upon extending therein, the bolt 29 applies a force against the arm 63 of the slide switching mechanism 64 thereby overcoming the force of the spring 60. The force plated on the arm 63 causes the first set of electrical contacts 38 on the arm 63 to move towards and into contact with the second set of electrical contacts 44 positioned on the base of the recess 15. When the first set of electrical contacts 38 are caused to contact the second set of electrical contacts 44, an electrical circuit is completed. Upon completion of the circuit a signal is sent to the transmitter indicating such. Upon receipt of this signal, the transmitter 34 signals the indicator 14 that the bolt 29 is in the locked position.

Figure 9:
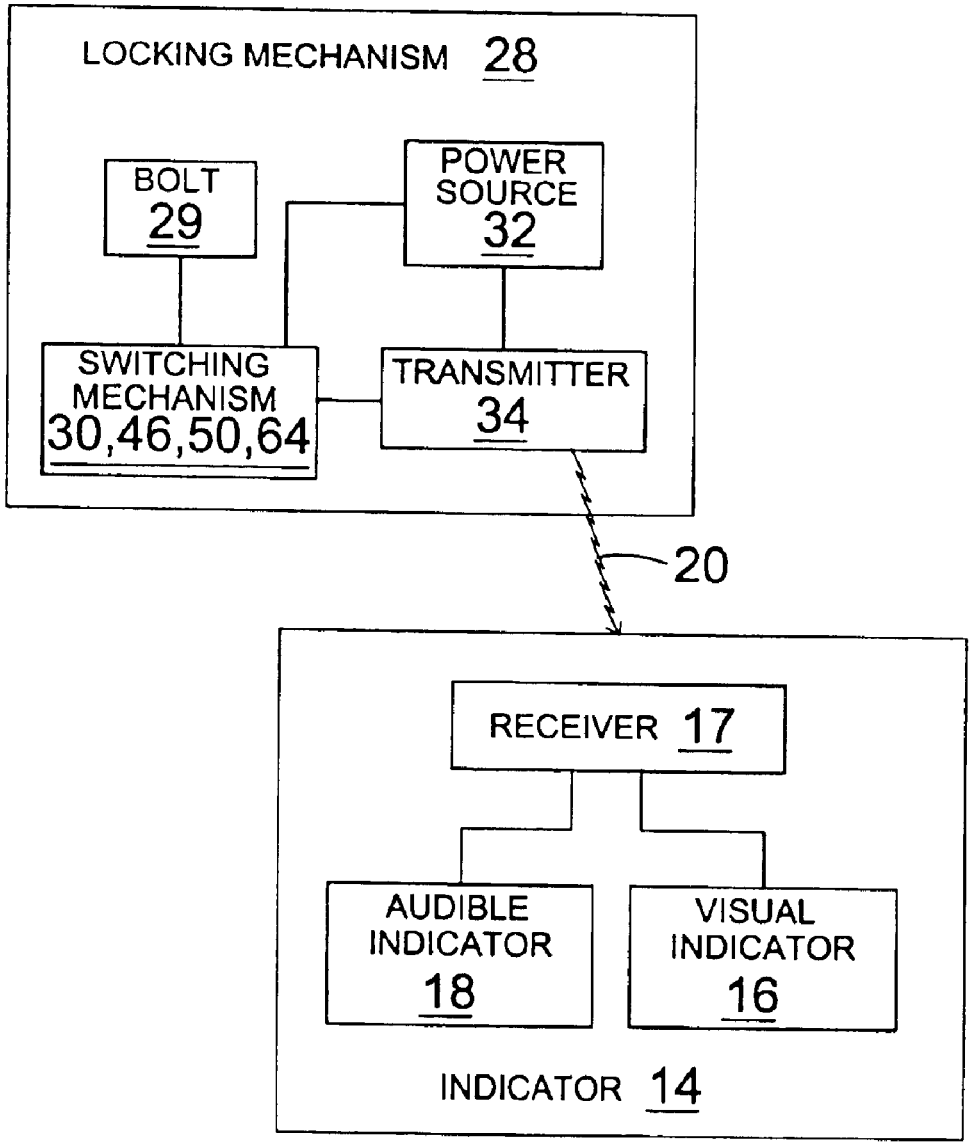
FIG. 9 is a block diagram of the bolt alarm system of the present invention.

FIG. 9 is a block diagram of the bolt alarm system of the present invention. The locking mechanism 28 includes a bolt 29, a power source 36, a transmitter 34, and a switching mechanism (30, 46, 50, 64). The switching mechanism determines the position of the bolt 29. The switching mechanisms that can be used to detect the position of the bolt 29 are at least one of a magnetic switching mechanism 30 as described above in FIGS. 4 and 5, a button switching mechanism 46 as described in FIG. 6, a spring loaded lever switching mechanism 50 as described in FIG. 7, and a slide switching mechanism 64 as described in FIG. 8. However, any switching mechanism that can determine the position of a bolt within a locking mechanism can be used. The switching mechanism provides a signal to the transmitter 34 indicating the position of the bolt 29, i.e. that the bolt is in the locked position or the unlocked position. Upon receipt of the signal, the transmitter 34 transmits a signal 20 to the indicator 14. The indicator 14 includes a receiver 17 for receiving the signal 20 from the transmitter 34. The receiver 17 then controls the visual indicator 16 and audible indicator 18 to alert a user as to the position of the bolt 29. The visual indicator can illuminate a first color when the bolt is in the locked position and a second color when the bolt is in the unlocked position. The audible indicator can emit a first auditory tone when the bolt is in the locked position and a second auditory tone when the bolt is in the unlocked position.

Figure 10:
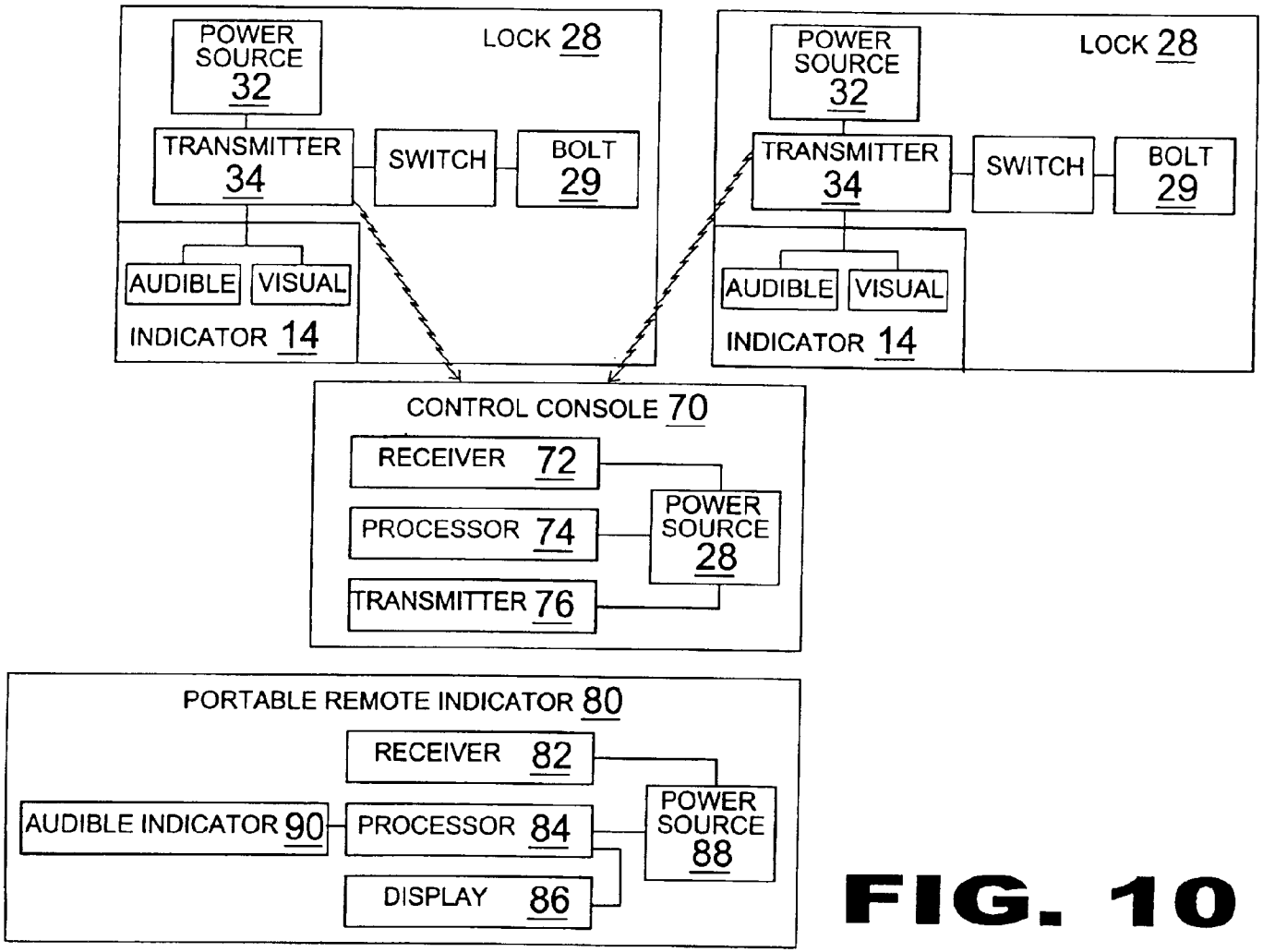
FIG. 10 is a block diagram of the bolt alarm of the present invention having a processor able to monitor a plurality of locks.

FIG. 10 is a block diagram of the bolt alarm of the present invention having a processor able to monitor a plurality of locks. FIG. 10 shows a plurality of locking mechanisms 28. Each respective locking mechanism 28 includes a bolt 29, a power source 36, a transmitter 34, and a switching mechanism 30, 46, 50, 64. Each switching mechanism determines the position of the respective bolt 29 to which it is connected. The switching mechanisms that can be used to detect the position of the bolt 29 are at least one of a magnetic switching mechanism 30 as described above in FIGS. 4 and 5, a button switching mechanism 46 as described in FIG. 6, a spring loaded lever switching mechanism 50 as described in FIG. 7, and a slide switching mechanism 64 as described in FIG. 8. However, any mechanism that can determine the position of a bolt within a locking mechanism can be used. The switching mechanism provides a signal to the transmitter 34 indicating the position of the bolt 29, i.e. that the bolt is in the locked position or the unlocked position. Upon receipt of the signal, the transmitter 34 transmits a signal 20 to a control console 70. The control console 70 is powered by a power source 28 and includes a receiver 72. The receiver 72 receives data signals from each of the plurality of locking mechanisms indicating the positions of each respective bolt 29. A processor 74 is connected to the receiver 72 for determining the position of each respective bolt within each respective locking mechanism. The processor 74 controls a transmitter 76 to transmit a signal to a remote indicator 80 which notifies the user of each respective position of the each bolt within the plurality of locking mechanisms. The remote indicator 80 is powered by a power source 88 and has a receiver 82 for receiving signals from the transmitter 76 of the control console 70. Upon receiving the signal from the transmitter 76 of the control console, the receiver 82 of the remote indicator 80 signals a processor 84. The processor 84 interprets the signal from the receiver 82 and determines the positions of each of the respective bolts 29 of each of the respective locking mechanism of the plurality of locking mechanisms 28. A display 86 is connected to the processor 84 for providing a visual indication of the position of the bolts in any of his respective locking mechanism. The visual indicator can illuminate a first color when the bolt is locked and a second color when the bolt is unlocked. An audible indicator 90 is also connected to the processor 84 for generating an auditory tone indicating the position of the bolt 29.

From the above description it can be seen that the present invention overcomes the shortcomings of the prior art by providing a bolt alarm that is integral to a locking mechanism for alerting a user when a bolt of the locking mechanism is in an unlocked position. The bolt alarm is able to determine whether the bolt is in a locked or unlocked position. The bolt alarm controls a transmitter to send a signal to a notification device indicative of the position of the bolt. The notification device includes at least one of a visual and audible indicator to alert a user as to the position of the bolt. Furthermore, the present invention is simple and easy to produce and use.

It will be understood that each of the elements described above, or two or more together may also find a useful application in other types of methods differing from the type described above.

While certain novel features of this invention has been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A system for determining the position of a bolt in a door comprising:

a) a locking mechanism for moving the bolt between a first locked position wherein the door is secured in position within a door frame and a second unlocked position wherein the door is moveable within the door frame;

b) means for determining the position of said bolt and generating a signal indicative of the position of the bolt;

c) a transmitter connected to said determining means; and d) means for indicating the position of the bolt, said indicating means includes a processor and receiver and wherein said transmitter transmits said signals generated by said determining means and said receiver receives said signal and provides said signal to said processor for determining the position of the bolt and generating a signal indicative of said determination, wherein said locking mechanism includes a cylinder, the bolt being at least partially received within said cylinder and said determining means is a magnetic switch mechanism comprising:

i) a first magnetic plate connected to an end of said bolt;

ii) a first set of electrical contacts positioned within said locking mechanism on a side of the said cylinder opposite said bolt;

iii) a second set of electrical contacts connected to said cylinder;

iv) a second magnetic plate having a third set of electrical contacts on a first side thereof and a fourth set of electrical contacts on a second side thereof; and v) a bias spring connecting said second side of said second magnetic plate to said second set of electrical contacts, wherein when said bolt is in said first locked position, said bias spring applies a force to said third set of electrical contacts causing said third set of electrical contacts to contact said first set of electrical contacts thereby generating a signal indicating that said bolt is in said first locked position and, when said bolt is in said second unlocked position, said first magnetic plate magnetically attracts said second magnetic plate thereto overcoming a bias force of said spring and bring said fourth set of electrical contacts into contact with said second set of electrical contacts thereby generating a signal indicating said bolt is in said second unlocked position.

2. The bolt alarm as recited in claim 1, wherein said indicating means has at least one of a visual indicator and an audible indicator for indicating to a user the position of said bolt within said locking mechanism.

3. The bolt alarm as recited in claim 2, wherein said visual indicator is a light having a first color for indicating said bolt is in said unlocked position and a second, different color, for indicating said bolt is in said locked position.

4. The bolt alarm as recited in claim 2, wherein said audible indicator generates a first tone for indicating said bolt is in said unlocked position, and generates a second different tone for indicating said bolt is in said locked position.

5. The bolt alarm as recited in claim 1, wherein said indicating means is a remote indicator comprising a housing, said receiver positioned within said housing for receiving a signal from said transmitter, and at least one of a visual indicator and an audible indicator.

6. The bolt alarm as recited in claim 5, wherein said visual indicator is a light having a first color for indicating said bolt is in said unlocked position and a second, different color, for indicating said bolt is in said locked position.

7. The bolt alarm as recited in claim 6, wherein said audible indicator generates a first tone for indicating said bolt is in said unlocked position, and generates a second different tone for indicating said bolt is in said locked position.

8. The bolt alarm as recited in claim 1, wherein said indicating means has at least one of a visual indicator and an audible indicator for indicating to a user the position of said bolt within said locking mechanism.

* * * * *